US005187455A

United States Patent [19]

Mandai et al.

[11] Patent Number: 5,187,455

[45] Date of Patent: Feb. 16, 1993

[54] DELAY LINE DEVICE WITH ADJUSTABLE TIME DELAY

[75] Inventors: Harufumi Mandai; Yoshikazu Chigodo; Atsushi Tojo, all of Kyoto, Japan

[73] Assignee: Murata Manufacturing Co., Ltd., Kyoto, Japan

[21] Appl. No.: 721,091

[22] Filed: Jun. 13, 1991

[30] Foreign Application Priority Data

Jun. 13, 1990 [JP] Japan ..... 2-156289

[51] Int. Cl.[5] ..... H01P 9/00

[52] U.S. Cl. ..... 333/161; 333/156

[58] Field of Search ..... 333/139, 140, 156, 161, 333/164, 246, 138; 336/200

[56] References Cited

U.S. PATENT DOCUMENTS 4,203,081 5/1980 Braeckelmann ..... 333/140 X 4,942,373 7/1990 Ozawa et al. ..... 333/161

FOREIGN PATENT DOCUMENTS 0199310 9/1986 Japan ..... 333/161

0214710 9/1987 Japan ..... 333/140

0065702 3/1988 Japan ..... 333/161

*Primary Examiner*—Paul M. Dzierzynski

*Assistant Examiner*—Seung Ham

*Attorney, Agent, or Firm*—Wegner, Cantor, Mueller & Player

[57] ABSTRACT

A delay line device for delaying signal transmission, comprising a dielectric layer, a grounding electrode layer disposed on one surface of the dielectric layer, a strip line conductor layer disposed on the other surface of the dielectric layer, an input terminal and an output terminal respectively connected to the strip line conductor layer at two positions, and a delay time adjusting electrode connected to at least one of the input and output terminals, a capacitance of which influences a delay time being obtained between the delay time adjusting electrode and the grounding electrode layer. The capacitance of the delay time adjusting electrode is adjustable, thereby permitting adjustment of the delay time.

15 Claims, 4 Drawing Sheets

DELAY LINE DEVICE WITH ADJUSTABLE TIME DELAY

BACKGROUND OF THE INVENTION

1) Field of the Invention

The present invention relates to a delay line device used to delay signal transmission in a computer, an instrumentation or the like and more particularly to a delay line device capable of adjusting a delay time.

2) Description of the Prior Art

As an example of a delay line device, there is one using a distributed constant circuit. FIG. 1 shows a delay line device of the so-called microstrip type in the above category. This delay line device comprises a meandering strip line conductor 31 formed on a main surface of a dielectric substrate 30 and a grounding electrode layer (not shown) formed on an opposite surface thereof. The length of the strip line conductor 31 determines a delay time obtained between an input lead terminal 32 and an output lead terminal 33. In order to change the delay time in this delay line device after manufacturing, an intermediate tap lead terminal 34 is connected to the strip line conductor 31 between the input and output lead terminals 32 and 33 and is used as an output terminal. The delay time can be adjusted by varying the position at which the intermediate tap lead terminal 34 is connected to the strip line conductor 31.

However, in the above delay line device, it is impossible to adjust the delay time after it is mounted on a printed circuit board since the positions of the input and output terminals are determined by the delay time. In addition, since one of the three lead terminals 32, 33 and 34 is not used after mounting, it has an undesired capacitance or acts as a stub which causes reflection of a signal. Further, when the strip line conductor 31 is meandering as shown in FIG. 1 , the position at which the intermediate tap lead terminal 34 is to be connected to the strip line conductor 31 is limited to the portions indicated by A. This prevents fine adjustment of the delay time.

SUMMARY OF THE INVENTION

The present invention has been made to solve the above problems and, therefore, has an object of providing a delay line device capable of adjusting a delay time after mounting without causing formation of unnecessary capacitance or reflection of a signal and capable of adjusting the delay time by the fine unit.

The above object is fulfilled by a delay line device for delaying signal transmission, comprising a dielectric layer, a grounding electrode layer disposed on one surface of the dielectric layer, a strip lineconductor layer disposed on the other surface of the dielectric layer, an input terminal and an output terminal respectively connected to the strip line conductor layer at two positions, and a delay time adjusting electrode connected to at least one of the input and output terminals, a capacitance which influences a delay time being obtained between the delay time adjusting electrode and the grounding electrode layer.

The delay line device may further comprise a first additional dielectric layer, a second additional dielectric layer, a third additional dielectric layer, and another grounding electrode layer, wherein the first additional dielectric layer and the second additional dielectric layer are laminated in this order from bottom to top with the above another grounding electrode layer therebetween, the strip line conductor layer, the dielectric layer and the grounding electrode layer are laminated on an upper surface of the second additional dielectric layer in this order, and the third additional dielectric layer is laminated on an upper surface of the grounding electrode layer, thereby forming a laminated body, and wherein the delay time adjusting electrode is provided on an upper surface of the third additional dielectric layer so that it is opposed to the grounding electrode layer.

The dielectric layer, the first additional dielectric layer, the second additional dielectric layer and the third additional dielectric layer may be formed of ceramics.

The delay time adjusting electrode may have a lengthy shape to be trimmed.

The strip line conductor layer may be meandering so that it has a length enough to obtain a predetermined delay time, both ends of the strip line conductor layer being connected to the input terminal and the output terminal.

At least one of the input terminal and the output terminal may be an outer electrode extending from a portion of the bottom surface to a portion of the upper surface across the side surface of the laminated body.

The strip line conductor layer may also be spiral.

At least one separate electrode may be provided in the vicinity of the delay time adjusting electrode, the separate electrode being connectable to the delay time adjusting electrode using a conductive material, whereby the capacitance obtained between the delay time adjusting electrode and the grounding electrode layer is substantially increased.

A portion of the grounding electrode layer may be cut out to save an area of the dielectric layer on which the delay time adjusting electrode is provided with an appropriate gap between the delay time adjusting electrode and the grounding electrode layer.

At least one of the input terminal and the output terminal may be a lead terminal having a holding portion for holding an end of the strip line conductor layer and the delay time adjusting electrode.

According to the above construction, the area of the delay time adjusting electrode can be changed by trimming it or connecting the separate electrode thereto, whereby the delay time can be adjusted. In addition, since the delay time adjusting electrode is directly connected to at least one of the input and output terminals, formation of unnecessary capacitance and reflection of a signal can be prevented. Further, since the area of the delay time adjustment electrode can be changed by the fine unit, the delay time can be adjusted by the fine unit.

BRIEF DESCRIPTION OF THE DRAWINGS

These and other objects, advantages and features of the invention will become apparent from the following description thereof taken in conjunction with the accompanying drawings which illustrate specific embodiments of the invention. In the drawings.

DESCRIPTION OF THE PREFERRED EMBODIMENTS

Figure 1:
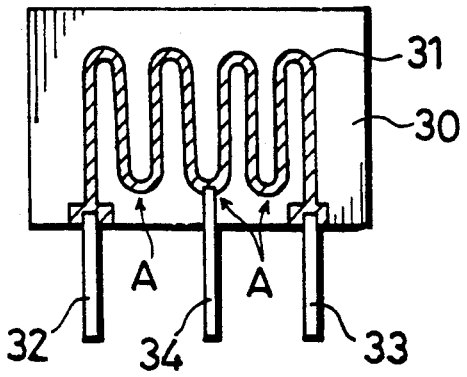
Fig. 1 Prior Art
FIG. 1 is a front view showing a conventional delay line device.
Figure 2:
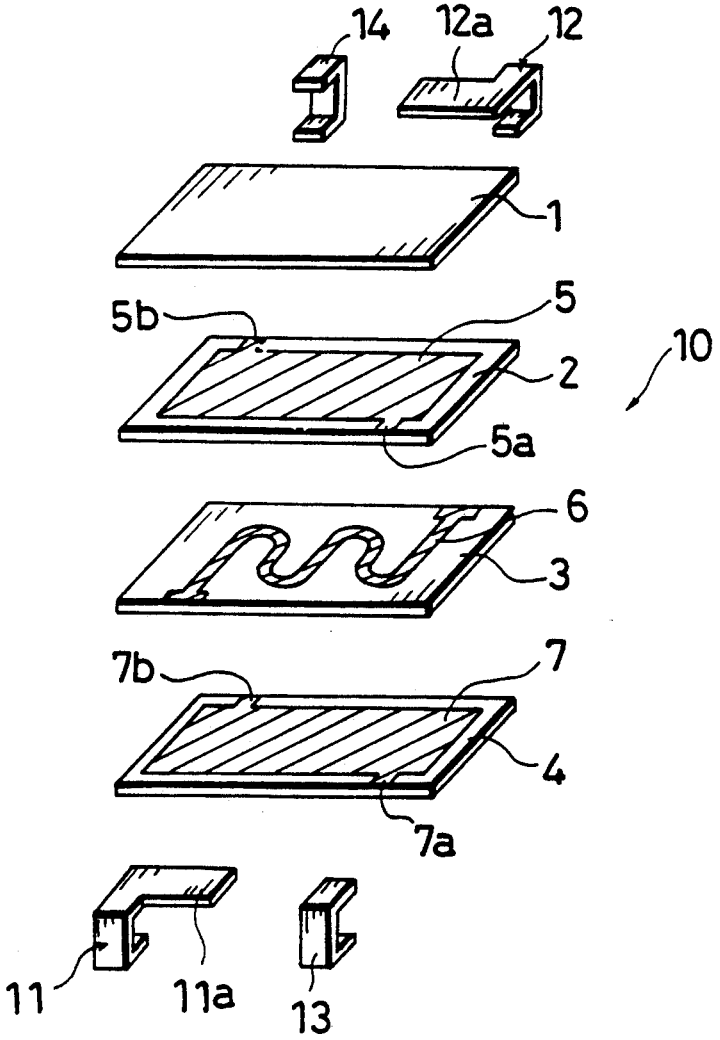
FIG. 2 is an exploded perspective view showing a delay line device according to the present invention.
Figure 3:
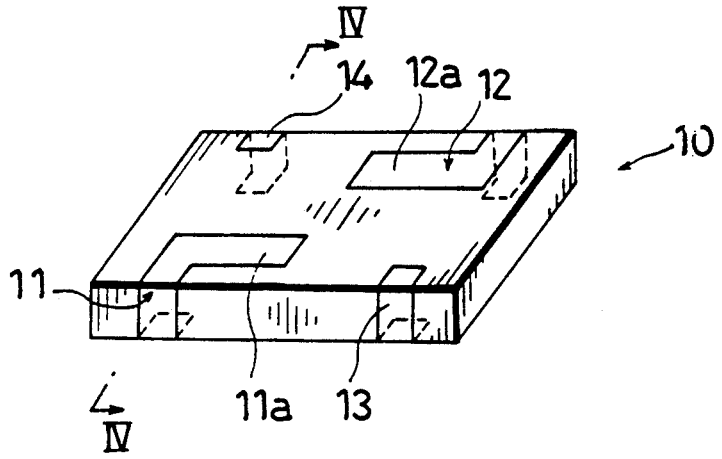
FIG. 3 is a perspective view showing a delay line device according to the present invention.

A delay line device according to an embodiment of the present invention has a construction as shown in FIG. 2.

A ceramic green sheet 4 having a grounding electrode layer 7 formed on an upper surface thereof, a ceramic green sheet 3 having a meandering strip line conductor 6 formed on an upper surface thereof, a ceramic green sheet 2 having a grounding electrode layer 5 formed on an upper surface thereof and a ceramic green sheet 1 having no electrode layer are laminated in this order, thereby forming a laminated body 10. Then, an input terminal electrode 11, an output terminal electrode 12 and two grounding terminal electrodes 13 and 14 are formed on the upper surface, bottom surface and side surfaces of the laminated body 10 by printing or the like. Then, the laminated body 10 having the above terminal electrodes formed thereon is sintered so that the green sheets 1–4 are integrated as dielectric layers 1–4. The terminal electrodes 11–14 may be formed after the laminated body 10 is sintered.

The grounding electrode layer 5 has connecting portions 5*a* and 5*b* and the grounding electrode layer 7 has connecting portions 7*a* and 7*b*. The connecting portions 5*a* and 7*a* are connected to the grounding terminal electrode 13 and the connecting portions 5*b* and 7*b* are connected to the grounding terminal electrode 14.

Figure 4:
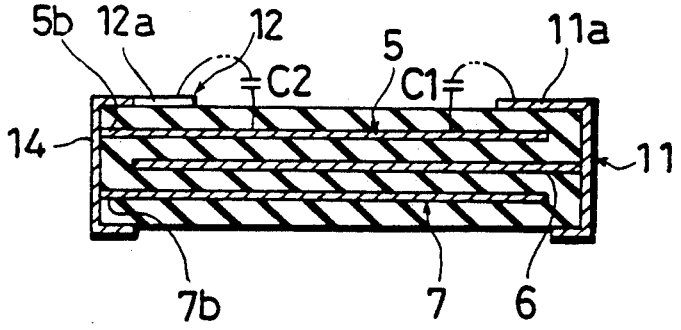
FIG. 4 is a cross section taken along the line IV—IV of FIG. 3.
Figure 5:
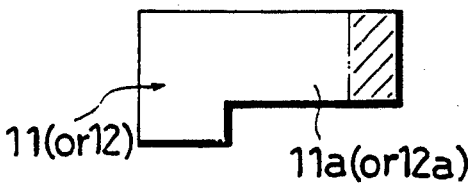
FIG. 5 is a view showing a delay time adjusting electrode.

The strip line conductor 6 disposed between the grounding electrode layers 5 and 7 has both ends thereof extended to be exposed on side surfaces of the laminated body 10. The exposed portions are respectively connected to the input and output terminal electrodes 11 and 12. Portions of the input and output terminals 11 and 12 opposed to the grounding electrode layer 5 have large areas and respectively act as delay time adjusting electrodes 11*a* and 12*a*. Thus, a capacitance C1 is obtained between the delay time adjusting electrode 11*a* and the grounding electrode layer 5 and a capacitance C2 between the delay time adjusting electrode 12*a* and the grounding electrode 5, both through the dielectric layer 1, as shown in FIG. 4. The capacitances C1 and C2 can be reduced by trimming the delay time adjusting electrodes 11*a* and 12*a* as shown in FIG. 5. When the capacitances C1 and C2 are reduced, the characteristic impedance is increased, whereby the delay time is shortened.

Figure 6:
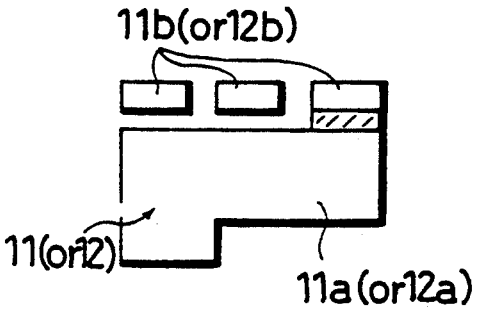
FIG. 6 is a view showing a separate electrode used when the delay time is to be extended.

On the other hand, the delay time can be extended as follows. That is, for example, three separate electrodes 11*b* (12*b*) are provided in the vicinity of the delay time adjusting electrode 11*a* (12*a*). Then, one separate electrode 11*b* (12*b*) is connected to the delay time adjusting electrode 11*a* (12*a*) using a conductive material as shown in FIG. 6 so that the area of the delay time adjusting electrode 11*a* (12*a*) is substantially increased. As a result, the delay time is extended. How much the delay time is extended can be changed by changing the number of the separate electrodes 11*b* (12*b*) to be connected to the delay time adjusting electrode 11*a* (12*a*).

In the above embodiment, both of the delay time adjusting electrodes 11*a* and 12*a* are provided on the upper surface of the laminated body 10. The delay time adjusting electrodes may be provided on the bottom surface or on both the upper and bottom surfaces of the laminated body.

Further, one delay time adjusting electrode connected to either the input terminal or the output terminal may be employed instead of two delay time adjusting electrodes connected to the input and output terminals as in the above embodiment.

Figure 7A:
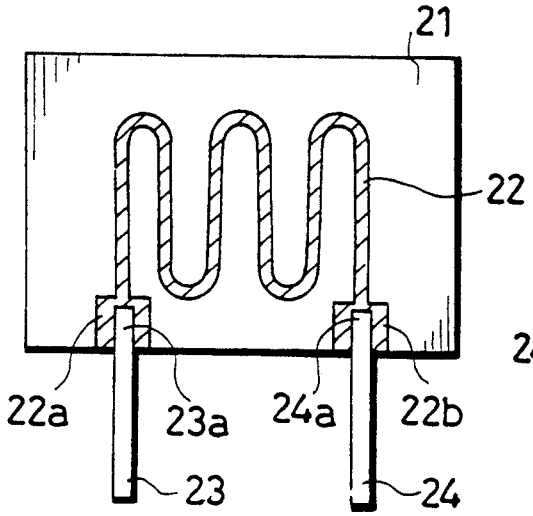
FIG. 7*a* is a front view showing another embodiment of the present invention.
Figure 7B:
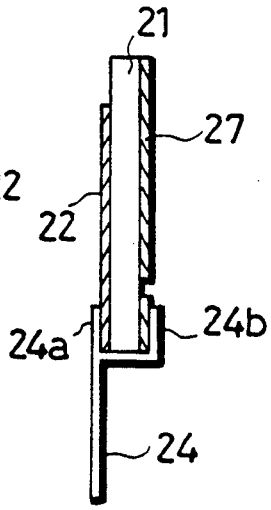
FIG. 7*b* is a right side view of FIG. 7*a*.
Figure 7C:
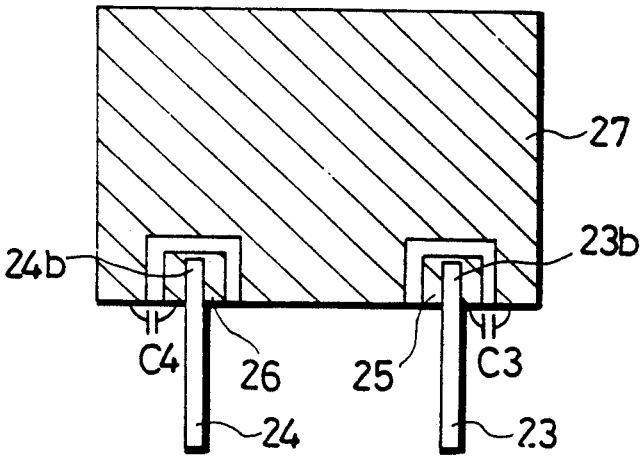
FIG. 7*c* is a rear view of FIG. 7*a*.
Figure 8:
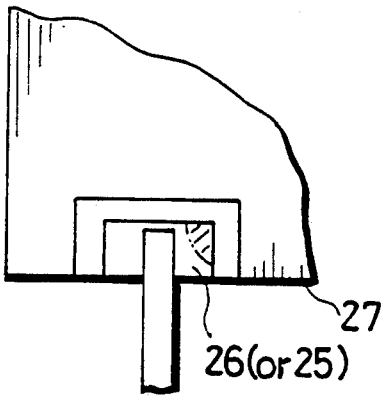
FIG. 8 is a view showing a delay time adjusting electrode of the delay line device of FIGS. 7*a*–7*c*.

FIG. 7 shows another embodiment of the present invention. In this embodiment, a strip line conductor 22 is formed on a main surface of a dielectric layer 21 and an input lead terminal 23 and an output lead terminal 24 are connected to both ends 22*a* and 22*b* of the strip line conductor 22. More specifically, the input lead terminal 23 has branch-like connecting portions 23*a* and 23*b* at one end thereof and the output lead terminal 24 has branch-like connecting portions 24*a* and 24*b* at one end thereof. The dielectric layer 21 has its one side inserted between the connecting portions 23*a* and 23*b* and between the connecting portions 24*a* and 24*b* so that the ends 22*a* and 22*b* are connected respectively to one connecting portion 23*a* and one connecting portion 24*a*. The other connecting portions 23*b* and 24*b* are respectively connected to delay time adjusting electrodes 25 and 26 formed on an opposite surface of the dielectric layer 21. A grounding electrode 27 is also formed on the opposite surface of the dielectric layer 21 so that it covers almost the whole surface except the delay time adjusting electrodes 25 and 26 with an appropriate gap therebetween. Thus, a capacitance C3 is obtained between the grounding electrode 27 and the delay time adjusting electrode 25 and a capacitance C4 between the grounding electrode 27 and the delay time adjusting electrode 26.

In the above construction, if the delay time adjusting electrode 26 (25) is trimmed to reduce the area thereof, the capacitance C4 (C3) is reduced, whereby the characteristic impedance is increased. As a result, the delay time is shortened.

In this embodiment also, the delay time adjusting electrodes may be provided for either the input terminal or the output terminal.

In the above two embodiments, one strip line conductor is formed. The present invention can also be applied to the case wherein two or more strip line conductors are connected in series to obtain a long delay time.

Figure 9:
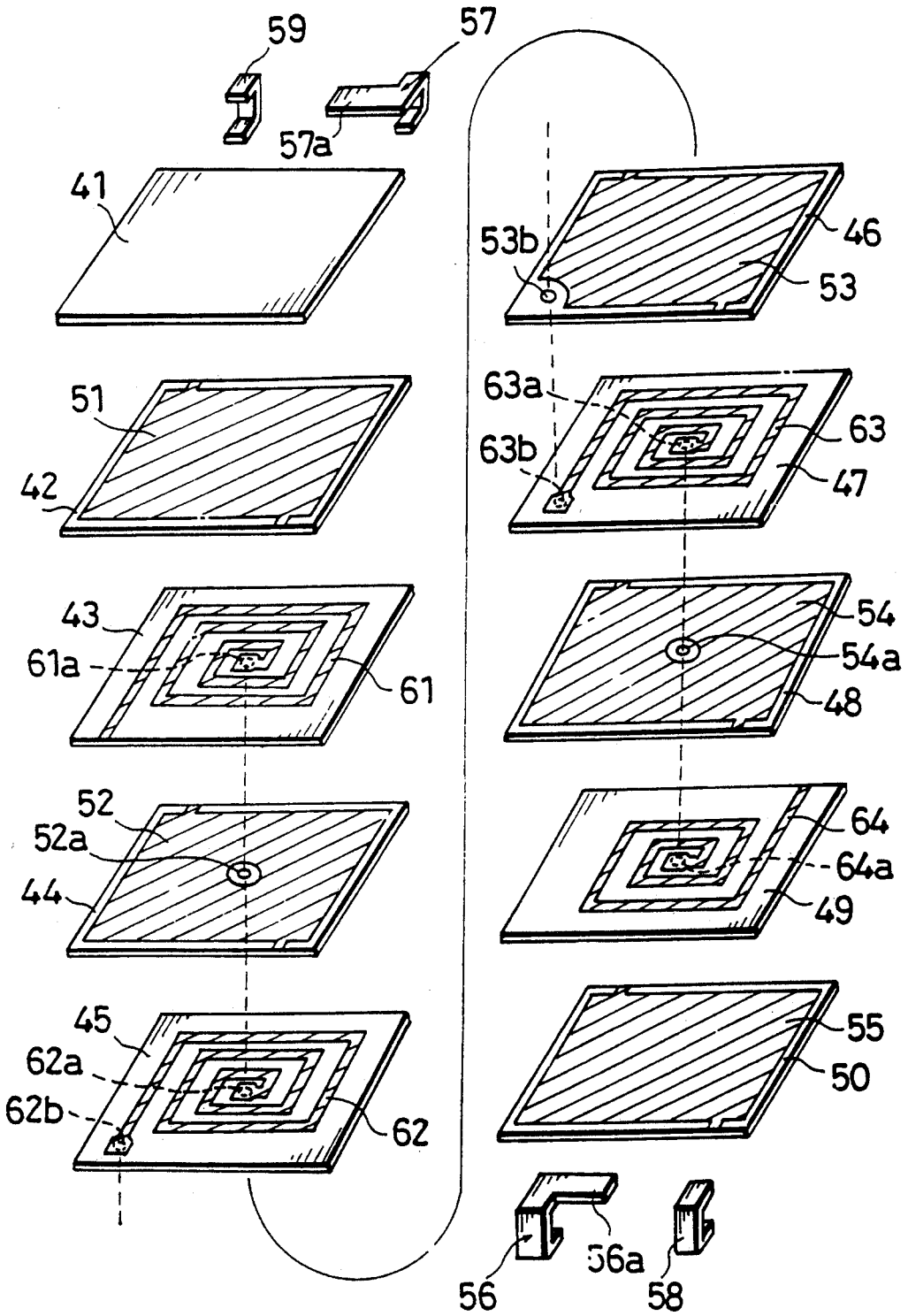
FIG. 9 is an exploded perspective view showing a delay line device having spiral strip line conductors.

The strip line conductor may be spiral as shown in FIG. 9 instead of meandering. In FIG. 9, the delay line device comprises dielectric layers 41 through 50, grounding electrodes 51 through 55 and strip line conductors 61 through 64. The spiral strip line conductors can be employed in even numbers. The strip line conductors are connected in series through holes 61*a*, 52*a*, 62*a*, 62*b*, 53*b*, 63*a*, 63*b*, 54*a* and 64*a*. Terminal electrodes 56, 57, 58 and 59 respectively correspond to the terminal electrodes 11, 12, 13 and 14 in FIG. 2 and delay time adjusting electrodes 56*a* and 57*a* respectively correspond to the delay time adjusting electrodes 11*a* and 12*a*.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A delay line device for delaying signal transmission, comprising:

a dielectric layer, a grounding electrode layer in contact with one surface of said dielectric layer, a strip line conductor layer in contact with the other surface of said dielectric layer, an input terminal and an output terminal electrically connected to said strip line conductor layer, and a delay time adjusting electrode connected to at least one of said input and output terminals, a capacitance of which influences a delay time being obtained between said delay time adjusting electrode and said grounding electrode layer.

2. A delay line device as claimed in claim 1, further comprising first and second additional dielectric layers; wherein said strip line conductor layer is between said first additional dielectric layer and said dielectric layer, said second additional dielectric layer is adjacent on said grounding electrode layer, and said delay time adjusting electrode is provided on an upper surface of said second additional dielectric layer so that it is opposed to said grounding electrode layer.

3. A delay line device as claimed in claim 2, further comprising a first additional grounding electrode layer and a third additional dielectric layer, wherein said first additional grounding electrode layer is between said first additional dielectric layer and said third additional dielectric layer.

4. A delay line device as claimed in claim 16, wherein said dielectric layer, said first additional dielectric layer, said second additional dielectric layer and said third additional dielectric layer are formed of ceramics.

5. A delay line device as claimed in claim 4, wherein said delay time adjusting electrode is elongate and can be trimmed to adjust capacitance.

6. A delay line device as claimed in claim 5, wherein said strip line conductor layer is meandering so that it has a length enough to obtain a predetermined delay time, both ends of said strip line conductor layer being connected to said input terminal and said output terminal.

7. A delay line device as claimed in claim 6, the device having a laminated body including a side surface, wherein at least one of said input terminal and said output terminal is an outer electrode extending from a portion of the bottom surface to a portion of the upper surface across the side surface of the laminated body.

8. A delay line device as claimed in claim 5, wherein said strip line conductor layer is spiral so that it has a length enough to obtain a predetermined delay time, both ends of said strip line conductor layer being connected to said input terminal and said output terminal.

9. A delay line device as claimed in claim 4, wherein at least one separate electrode is provided in the vicinity of said delay time adjusting electrode, said separate electrode being connectable to said delay time adjusting electrode using a conductive material, whereby the capacitance obtained between said delay time adjusting electrode and said grounding electrode layer is substantially increased.

10. A delay line device as claimed in claim 8, wherein said strip line conductor layer is meandering so that it has an enough length to obtain a predetermined delay time, both ends of said strip line conductor layer being connected to said input terminal and said output terminal.

11. A delay line device as claimed in claim 10, the device having a lamianted body including a side surface, wherein at least one of said input terminal and said output terminal is an outer electrode extending from a portion of the bottom surface to a portion of the upper surface across the side surface of the laminated body.

12. A delay line device as claimed in claim 9, wherein said strip line conductor layer is spiral so that it has an enough length to obtain a predetermined delay time, both ends of said strip line conductor layer being connected to said input terminal and said output terminal.

13. A delay line device as claimed in claim 1, wherein said grounding electrode layer has a shape so as not to cover an area of said dielectric layer on which said delay time adjusting electrode is provided, with an appropriate gap being provided between said delay time adjusting electrode and said grounding electrode layer.

14. A delay line device as claimed in claim 13, said dielectric layer is formed of a ceramic.

15. A delay line device as claimed in claim 14, at least one of said input terminal and said output terminal is a lead terminal having a holding portion for holding an end of said strip line conductor layer and said delay time adjusting electrode.

* * * * *